US007047951B2

(12) United States Patent
Rado

(10) Patent No.: US 7,047,951 B2
(45) Date of Patent: May 23, 2006

(54) CENTRIFUGALLY OPERATED EVAPORATIVE EMISSIONS CONTROL VALVE SYSTEM FOR INTERNAL COMBUSTION ENGINES

(75) Inventor: Gordon E Rado, Thief River Falls, MN (US)

(73) Assignee: Tecumseh Products Company, Tecumseh, MI (US)

( * ) Notice: Subject to any disclaimer, the term of this patent is extended or adjusted under 35 U.S.C. 154(b) by 57 days.

(21) Appl. No.: 10/910,653

(22) Filed: Aug. 3, 2004

(65) Prior Publication Data

US 2005/0092305 A1 May 5, 2005

Related U.S. Application Data

(60) Provisional application No. 60/508,742, filed on Oct. 3, 2003.

(51) Int. Cl.
*F02M 33/02* (2006.01)

(52) U.S. Cl. ..... 123/518; 261/DIG. 67

(58) Field of Classification Search ..... 123/518, 123/516, 517, 520; 261/36.2, 50.1, DIG. 67
See application file for complete search history.

(56) References Cited

U.S. PATENT DOCUMENTS

| | | | | |
|---|---|---|---|---|
| 1,773,076 A | | 8/1930 | King | |
| RE18,194 E | | 9/1931 | French | |
| 2,003,478 A | | 6/1935 | Bovard | 123/32 |
| 3,258,254 A | | 6/1966 | Jakob | 261/36 |
| 3,547,415 A | | 12/1970 | Perry | 261/50 |
| 3,554,175 A | * | 1/1971 | Sarto | 123/519 |
| 3,572,659 A | | 3/1971 | Kizlauskas | 261/43 |
| 3,578,293 A | | 5/1971 | Santi | 261/64 |
| 3,645,244 A | | 2/1972 | Sayfarth | 123/136 |
| 4,044,743 A | | 8/1977 | Eaton | 123/136 |
| 4,111,176 A | | 9/1978 | Fenton et al. | 123/198 DB |
| 4,212,276 A | | 7/1980 | Kaneda | 123/516 |
| 4,270,504 A | | 6/1981 | Sciotti et al. | 123/520 |
| 4,765,504 A | | 8/1988 | Sherwood et al. | 220/86 R |
| 4,932,444 A | | 6/1990 | Micek | 141/59 |
| 4,953,583 A | | 9/1990 | Szlaga | 137/118 |
| 4,982,715 A | | 1/1991 | Foster | 123/518 |
| 5,054,508 A | | 10/1991 | Benjey | 137/43 |
| 5,398,713 A | | 3/1995 | Whitman | 137/54 |

(Continued)

*Primary Examiner*—Mahmoud Gimie
(74) *Attorney, Agent, or Firm*—Baker & Daniels

(57) ABSTRACT

An evaporative emissions control system for small internal combustion engines. A control valve assembly includes a pair of control valves which are respectively associated with a fuel line and with a vent line which each connect the fuel tank and the carburetor of the engine. The control valve assembly is automatically operable responsive to the rotation of a rotatable member of the engine drive train, such as the crankshaft, camshaft, flywheel, governor assembly, or other rotatable member. In one embodiment, for example, the control valve assembly is driven from the flywheel. When the engine is not running, the flywheel is stationary and does not rotate, and the control valves automatically closes the vent line and the fuel line, thereby trapping fuel vapors within the fuel tank and blocking the supply of liquid fuel to the carburetor. Upon cranking of the engine for start up, a flyweight mechanism of the control valve is driven by rotation of the flywheel, and centrifugal force acting on the flyweight mechanism causes the control valve to automatically open the vent line and the fuel line, venting fuel vapors from the fuel tank through the vent line to the carburetor for consumption by the engine, and opening the supply of liquid fuel from the fuel tank to the carburetor.

19 Claims, 3 Drawing Sheets

U.S. PATENT DOCUMENTS

| | | | | |
|---|---|---|---|---|
| 5,480,293 | A | 1/1996 | Dinca et al. | 417/462 |
| 5,687,762 | A | 11/1997 | Teets et al. | 137/588 |
| 6,082,323 | A | 7/2000 | Winberg | 123/198 DB |
| 6,213,083 | B1 | 4/2001 | Winberg | 123/198 DB |
| 6,640,770 | B1 | 11/2003 | Woody | 123/198 D |
| 6,691,683 | B1 * | 2/2004 | Gracyalny et al. | 123/516 |
| 6,959,696 | B1 | 11/2005 | Shears et al. | 123/516 |
| 2002/0112701 | A1 | 8/2002 | Gracyalny et al. | 123/516 |
| 2002/0139355 | A1 | 10/2002 | Gracyalny et al. | 123/516 |
| 2003/0111062 | A1 | 6/2003 | Brandenburg et al. | 123/516 |

* cited by examiner

CENTRIFUGALLY OPERATED EVAPORATIVE EMISSIONS CONTROL VALVE SYSTEM FOR INTERNAL COMBUSTION ENGINES

CROSS REFERENCE TO RELATED APPLICATIONS

The present application claims the benefit under Title 35, U.S.C. § 119(e) of U.S. Provisional Patent Application Ser. No. 60/508,742, entitled CENTRIFUGALLY OPERATED EVAPORATIVE EMISSIONS CONTROL VALVE SYSTEM FOR INTERNAL COMBUSTION ENGINES, filed on Oct. 3, 2003.

BACKGROUND OF THE INVENTION

1. Field of the Invention

The present invention relates to small internal combustion engines of the type used with lawnmowers, lawn tractors, other utility implements, or in sport vehicles. In particular, the present invention relates to emissions control systems for such engines.

2. Description of the Related Art

Small internal combustion engines of the type used with lawnmowers, lawn tractors, other small utility implements, or sport vehicles typically include an intake system including a carburetor attached to the engine which mixes liquid fuel with atmospheric air to form a fuel/air mixture which is drawn into the engine for combustion.

One known type of carburetor includes a fuel bowl containing a supply of liquid fuel therein which is drawn into the throat of the carburetor to mix with atmospheric air. A float within the fuel bowl actuates a valve which meters liquid fuel into the fuel bowl from a fuel tank. In another known type of carburetor, a diaphragm pump attached to the crankcase of the engine is actuated by pressure pulses within the engine to pump fuel from a fuel tank into a fuel chamber within the carburetor, from which the fuel is drawn into the throat of the carburetor to mix with atmospheric air.

In each of the foregoing arrangements, the carburetor is attached via a fuel line to a fuel tank, which stores a quantity of liquid fuel therein. The fuel tank includes a filler neck through which fuel may be filled into the fuel tank, and a fuel tank cap is attached to the filler neck to close the fuel tank. The fuel tank cap usually includes venting structure therein for allowing any pressurized fuel vapors within the fuel tank to vent through the fuel tank cap to the atmosphere. Also, the venting structure allows atmospheric air to enter the fuel tank from the atmosphere as necessary to displace volume within the fuel tank as the fuel within the fuel tank is consumed by the engine.

A problem with the existing intake and fuel supply systems of such small internal combustion engines is that fuel vapors may escape therefrom into the atmosphere, such as from the carburetor or from the fuel tank.

What is needed is a fuel supply system for small internal combustion engines which prevents the escape of fuel vapors into the atmosphere, thereby controlling and/or substantially eliminating fuel vapor emissions from such engines.

SUMMARY OF THE INVENTION

The present invention provides an evaporative emissions control system for small internal combustion engines. A control valve assembly includes a pair of control valves which are respectively associated with a fuel line and with a vent line which each connect the fuel tank and the carburetor of the engine. The control valve assembly is automatically operable responsive to the rotation of a rotatable member of the engine drive train, such as the crankshaft, camshaft, flywheel, governor assembly, or other rotatable member. In one embodiment, for example, the control valve assembly is driven from the flywheel. When the engine is not running, the flywheel is stationary and does not rotate, and the control valves automatically closes the vent line and the fuel line, thereby trapping fuel vapors within the fuel tank and blocking the supply of liquid fuel to the carburetor. Upon cranking of the engine for start up, a flyweight mechanism of the control valve is driven by rotation of the flywheel, and centrifugal force acting on the flyweight mechanism causes the control valve to automatically open the vent line and the fuel line, venting fuel vapors from the fuel tank through the vent line to the carburetor for consumption by the engine, and opening the supply of liquid fuel from the fuel tank to the carburetor.

Advantageously, the control valve assembly is automatically actuated by rotation of a rotatable member of the engine drive train, such as the crankshaft, camshaft, flywheel, or governor assembly of the engine, for example, such that manual control of the control valve assembly by the operator of the engine is not required. Specifically, when the engine is stopped and the engine drive train is stationary, the control valve automatically seals the fuel tank to prevent fuel vapors from escaping the fuel tank and to prevent the supply of liquid fuel from the fuel tank to the carburetor. When the engine is cranked for starting, rotation of the engine drive train automatically opens the control valve assembly to vent fuel vapors from the fuel tank to the intake system of the engine and to open the supply of liquid fuel from the fuel tank to the carburetor.

In one form thereof, the present invention provides an internal combustion engine, including a drive train including a rotatable member; a carburetor; a fuel tank; and a control valve assembly in fluid communication with the fuel tank and with the carburetor, the control valve assembly including at least one valve member mechanically movable by the rotatable member between a first position when the rotatable member is stationary, in which the valve member prevents fluid communication between the fuel tank and the carburetor, and a second position upon rotation of the rotatable member, in which the valve member allows fluid communication between the fuel tank and the carburetor.

In another form thereof, the present invention provides an internal combustion engine, including a drive train including a rotatable member; a carburetor; a fuel tank; and a control valve assembly in fluid communication with the fuel tank and with the carburetor, the control valve assembly including a flyweight mechanism in driven relationship with the rotatable member; at least one valve member movable by the flyweight mechanism between a first position when the rotatable member is stationary, in which the valve member prevents fluid communication between the fuel tank and the carburetor, and a second position upon rotation of the rotatable member, in which the valve member allows fluid communication between the fuel tank and the carburetor.

In a further form thereof, the present invention provides an internal combustion engine, including a drive train including a rotatable member; a carburetor; a fuel tank; a fuel line and a vent line fluidly communicating the fuel tank and the carburetor; and control valve means mechanically driven by the rotatable member for preventing flow of fuel and fuel vapors from the fuel tank to the carburetor through the fuel line and the vent line, respectively, when the rotatable member is stationary, and for allowing flow of fuel and fuel vapors from the fuel tank to the carburetor through the fuel line and the vent line, respectively, upon rotation of the rotatable member.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention any manner.

DETAILED DESCRIPTION

Figure 1:
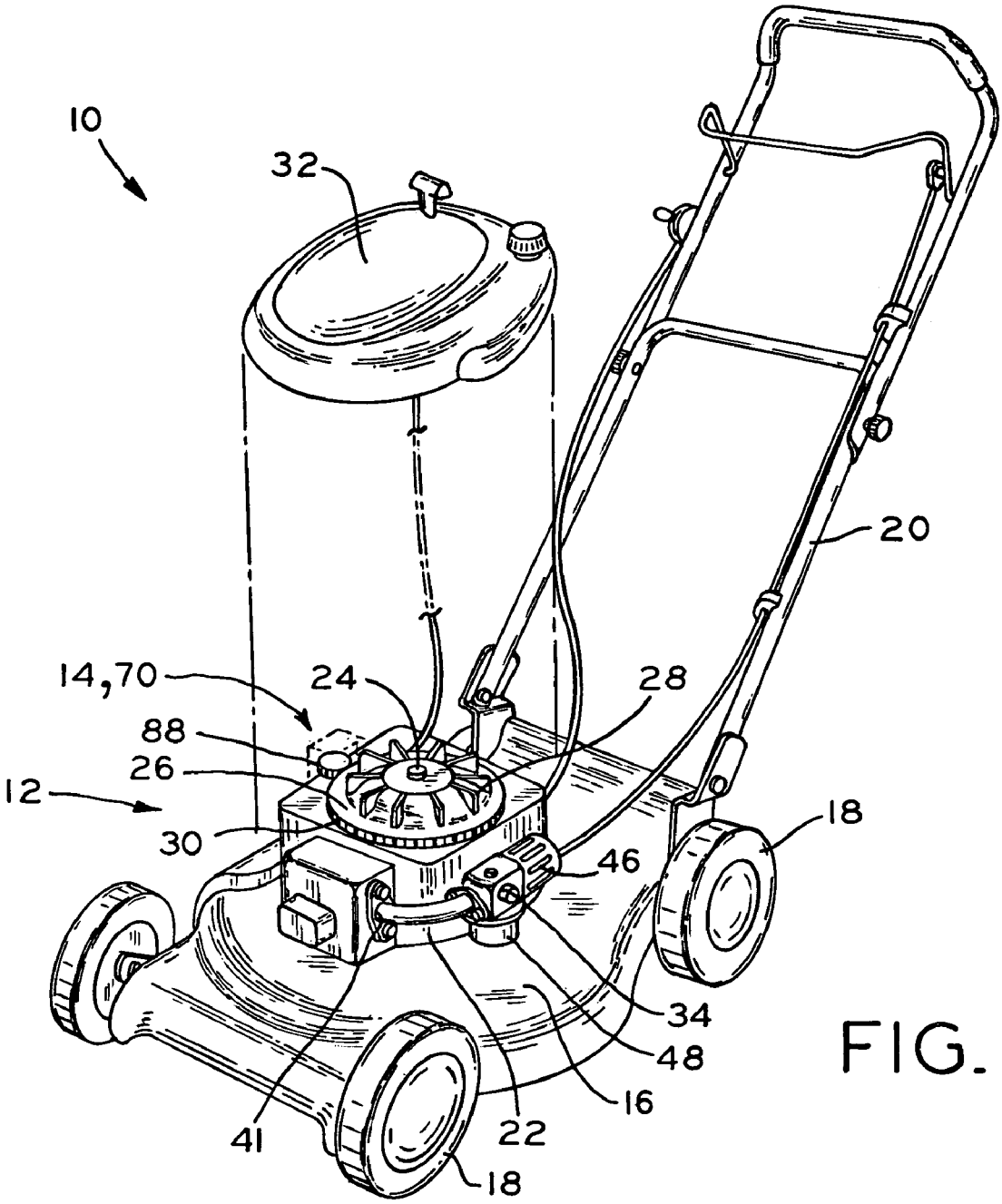
FIG. 1 is perspective view of an exemplary implement, shown as a lawnmower, including a small internal combustion engine having an evaporative emissions control system of the present invention.

Referring to FIG. 1, lawnmower 10 is shown as an exemplary implement with which a small internal combustion engine 12 may be used, with engine 12 including an evaporative emissions control system 14 according to the present invention, which is described below. Engine 12 may be a single or twin cylinder engine having either a vertical or a horizontal crankshaft. Engine 12 and evaporative emissions control system 14 may be used with lawnmower 10, or alternatively, may be used with other types of implements such as lawn tractors, other utility implements, compressors, or in sport vehicles, for example. Lawnmower 10 includes deck 16 with wheels 18, and handle 20 extending upwardly from deck 16. Engine 12 includes crankcase 22 having a drive train therein, including a vertically oriented crankshaft 24 rotatably supported in crankcase 22, and flywheel 26 attached to an end of crankshaft 22 which extends externally of crankcase 22. Exemplary small internal combustion engines having drive trains with the foregoing types of rotatable components are discussed in detail in U.S. Pat. Nos. 6,276,324, 6,279,522, 6,295,959, 6,499,453, and 6,612,275, each assigned to the assignee of the present invention, the disclosures of which are expressly incorporated herein by reference. Flywheel 26 includes a plurality of fins 28 thereon, for directing cooling air about engine 12 beneath shroud 32 which covers the upper portion of engine 12. Flywheel 26 additionally includes ring gear 30 about its outer circumference.

Other components of the drive train of engine 12 may include a camshaft driven from crankshaft 22, the camshaft disposed within crankcase 22 or within a cylinder head of engine 12. Further, the drive train of engine 12 may include one or more idler shafts or an auxiliary power take-off ("PTO") shaft driven from crankshaft 24. Also, the drive train of engine 12 may include a rotatable governor assembly or another device rotatably driven from crankshaft 24, such as an oil pump, for example, wherein each of the foregoing components includes a rotatable member which is driven from crankshaft 24.

Figure 2:
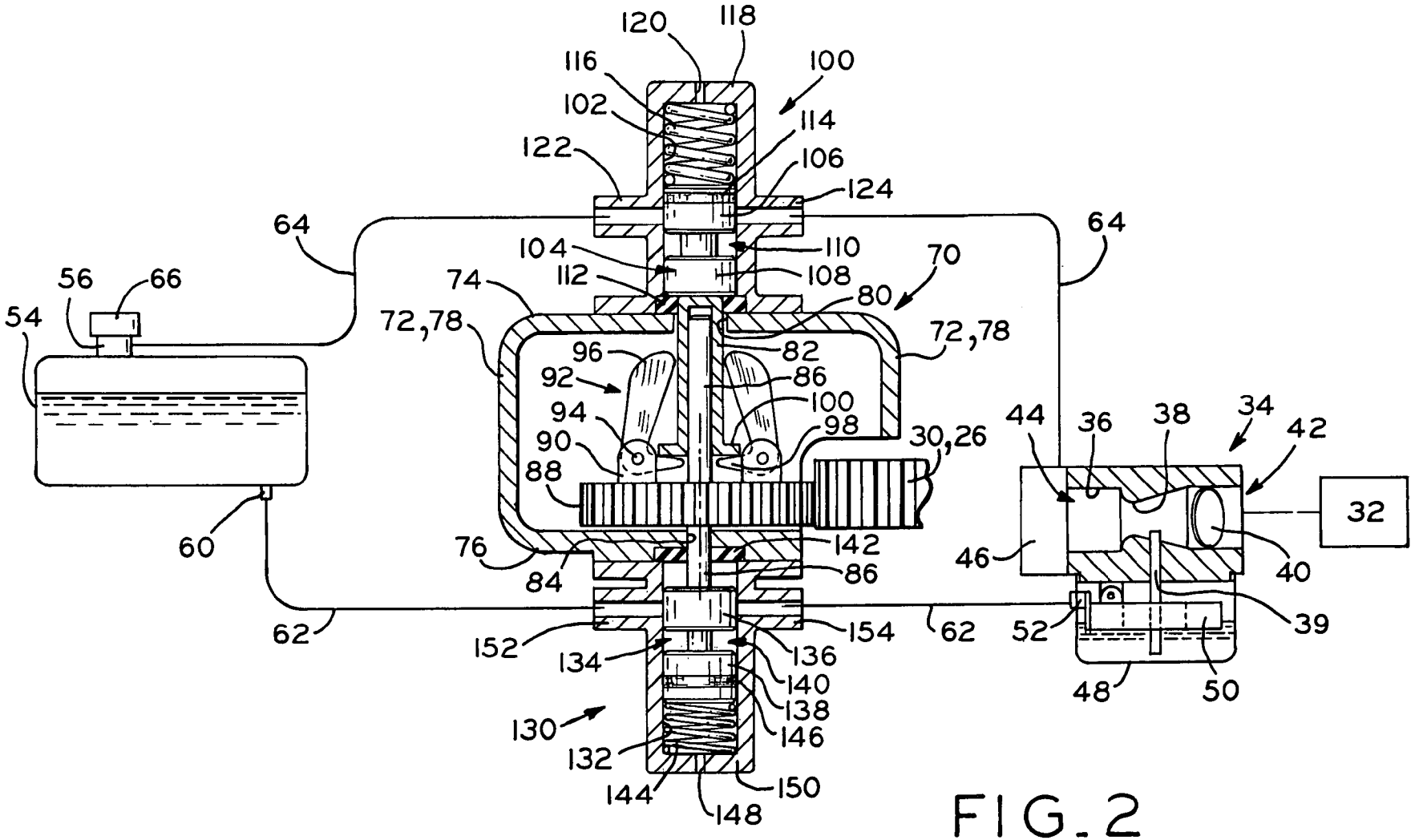
FIG. 2 is a schematic view of the evaporative emissions control system of the present invention, showing the control valve assembly in a first or closed position corresponding to the engine being stopped, in which the control valve seal fuel vapors within the fuel tank and blocks the supply of liquid fuel from the fuel tank to the carburetor.
Figure 3:
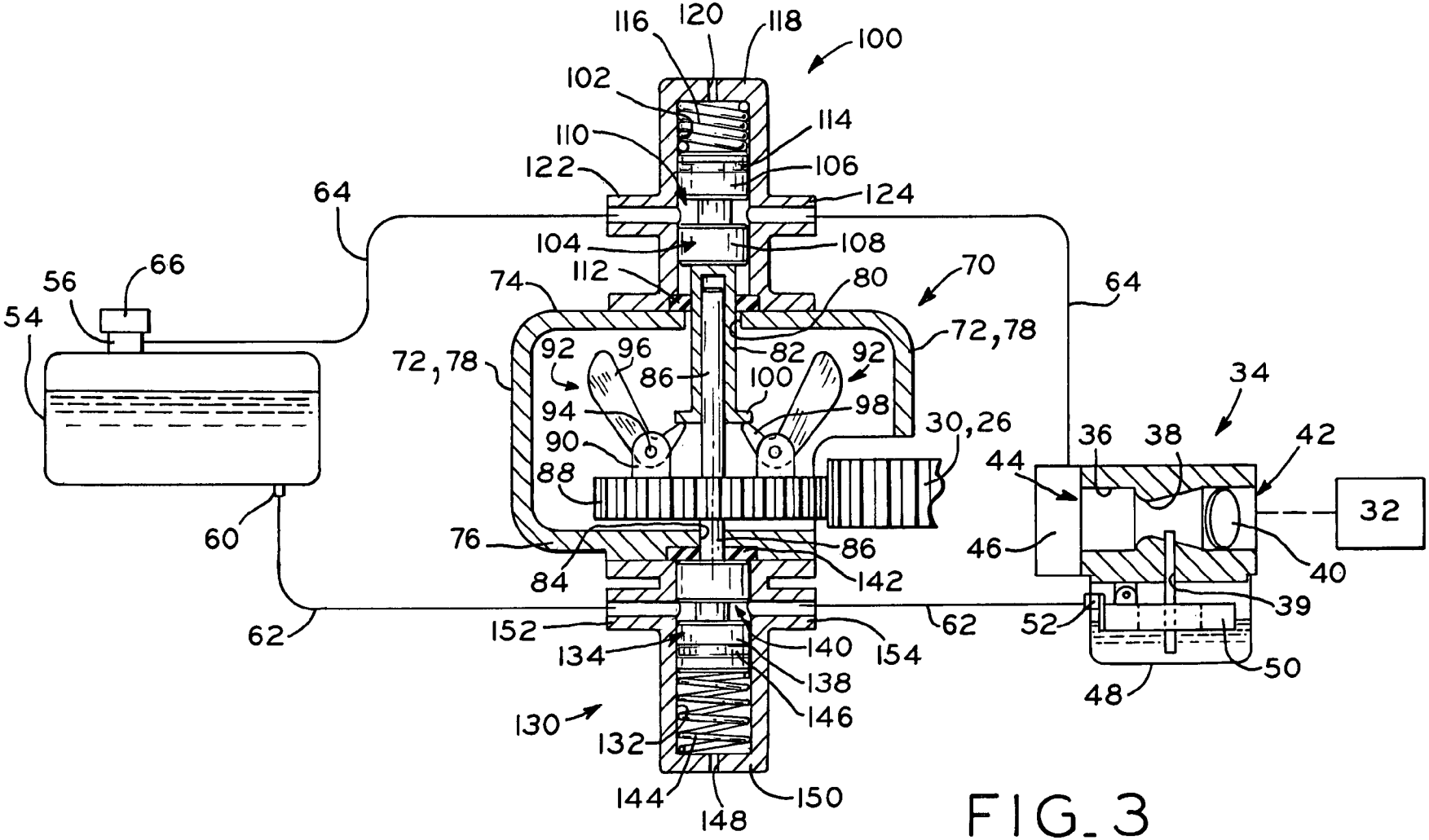
FIG. 3 is a schematic view of the evaporative emissions control system of FIG. 2, showing the control valve assembly in a second or open position corresponding to cranking and running speeds of the engine, in which the control valve allows fuel vapors within the fuel tank to pass to the intake system of the engine and allows the supply of liquid fuel from the fuel tank to the carburetor.

Referring additionally to FIGS. 2 and 3, the intake system of engine 12 includes carburetor 34 having throat 36 with venturi 38 and throttle valve 40 therein, as well as outlet 42 in communication with the intake port 41 (FIG. 1) of engine 32, and inlet 44 to which air filter 46 is attached. Carburetor 34 may also include a choke valve (not shown) rotatably disposed within throat 36 upstream of throttle valve 40. Carburetor 34 further includes fuel bowl 48 containing a quantity of liquid fuel therein which, when engine 32 is running, is drawn into throat 36 of carburetor 34 through main fuel nozzle or jet 39 by the vacuum within throat 36 in a conventional manner to mix with atmospheric air, thereby forming an air/fuel mixture which is drawn into engine 32 for combustion. Float 50 floats on the fuel within fuel bowl 48, and is operatively connected to bowl valve assembly 52 to meter the supply of liquid fuel into fuel bowl 48 from fuel tank 54. Although carburetor 34 is shown herein as a fuel bowl-type carburetor, the present emissions control system may also be used with other types of carburetors, such as diaphragm-type carburetors, and further, may also be used in engines having a fuel injection system rather than a carburetor.

Fuel tank 54 may be mounted to engine 32, or alternatively, may be located remotely from engine 32, and includes filler neck 56 through which fuel may be filled into fuel tank 54. Fuel within fuel tank 54 is communicated through fuel outlet 60 of fuel tank 54 and fuel line 62 to fuel bowl 48 of carburetor 34. Vent line 64 connects fuel tank 54 to the inlet side 44 of carburetor 34. For example, vent line 64 is shown in FIGS. 2 and 3 attached to air filter 46. Alternatively, vent line 64 may also be connected between air filter 46 and inlet 44 of carburetor 34, or may be connected directly to inlet 44 of carburetor 34, such as to the air horn of throat 36 of carburetor 34. Filler neck 56 of fuel tank 54 includes a fuel tank sealing and venting assembly 66 associated therewith, such as those described in U.S. patent application Ser. No. 10/656,305, entitled EMISSIONS CONTROL SYSTEM FOR SMALL INTERNAL COMBUSTION ENGINES, filed on Sep. 4, 2003, assigned to the assignee of the present invention, the disclosure of which is expressly incorporated herein by reference. Generally, the fuel tank sealing and venting assembly 66 includes a fuel tank cap operable to prevent the escape of fuel vapors from fuel tank 54 into the atmosphere, while permitting either fuel vapors to pass from fuel tank 54 to carburetor 34 or air to pass from carburetor 34 to fuel tank 54, as necessary. Alternatively, vent line 64 may be connected directly to filler neck 56 as shown in FIG. 2, and a fuel tank cap may completely seal filler neck 56 in an air-tight manner. In this manner vent line 64 is in communication with the space above the fuel in fuel tank 54, such that fuel vapors from the fuel within fuel tank 54 may pass into vent line 64.

Referring to FIGS. 2 and 3, an exemplary control valve assembly 70 is shown, which is driven from a rotatable member of the drive train of engine 12. For example, in FIGS. 2 and 3, control valve assembly 70 is driven from flywheel 26 of engine 12. Control valve assembly 70 includes housing 72 mounted to crankcase 22 or to another suitable portion of engine 12 proximate flywheel 26. Housing 72 generally includes upper wall 74 and lower wall 76 connected by side walls 78. Hole 80 is formed in upper wall 74 for rotatably supporting hollow spool shaft 82, and lower wall 76 includes bearing 84 rotatably supporting central shaft 86. Gear 88 is keyed to central shaft 86, and is in meshing, driven engagement with ring gear 30 of flywheel 26. Gear 88 includes two or more flyweight mounts 90 to which two or more flyweights 92 are respectively pivotally mounted on pins 94. Flyweights 92 are generally L-shaped, and each include flyweight portion 96 and engagement portion 98, with engagement portions 98 each abutting end 100 of spool shaft 82, which is slidable axially upon central shaft 86.

First or upper valve housing 100 is mounted to upper wall 74 of control valve housing 72, and generally includes bore 102 therein in which spool valve 104 is slidably disposed. Spool valve 104 includes a pair of shoulders 106 and 108 with an annular groove 110 therebetween, and shoulders 106 and 108 are in sliding engagement with the interior surface of bore 102. Shoulder 108 is disposed in abutment with the upper end of spool shaft 82, and seal 112 is provided at the base of bore 102 of first valve housing 100 to provide a seal between first valve housing 100 and the outer surface of spool shaft 82. Another O-ring 114 is provided about shoulder 106 to slidingly seal shoulder 106 with the interior surface of bore 102. First spring 116 is disposed within first valve housing 100 between end wall 118 of first valve housing 100 and shoulder 106, and normally biases spool valve 104 to the position shown in FIG. 1. As discussed below, first spring 116 has a relatively strong or heavy spring force. Vent hole 120 is provided in end wall 118 of first valve housing 100 to allow air to vent therethrough between first valve housing 100 and the atmosphere. First valve housing 100 additionally includes inlet port 122 and outlet port 124.

Second valve housing 130 is mounted to lower wall 76 of control valve housing 72, and generally includes bore 132 therein in which central shaft 86 and spool valve 134 are received. Spool valve 134 may be formed as a portion of central shaft 86, and includes first and second shoulders 136 and 138 with annular groove 140 therebetween. Seal 142 is provided at the upper end of second valve housing 130 to provide a sliding seal between second valve housing 130 and the outer surface of central shaft 86. Second spring 144 is disposed within second valve housing 130 between end wall 150 of second valve housing 130 and shoulder 138, and normally biases spool valve 134 and central shaft 86 in an upward direction as shown in FIG. 2. For the reasons discussed below, second spring 144 has a relatively weak or light spring force in comparison with that of first spring 116. O-ring 146 is carried by shoulder 138 and provides a sliding seal with bore 132. Vent hole 148 is provided in end wall 150 of second valve housing 130 for allowing venting of air between the interior of second valve housing 130 and the atmosphere. Additionally, second valve housing 130 includes inlet port 152 and outlet port 154.

In the embodiment shown in FIGS. 1 and 2, inlet port 122 and outlet port 124 of first valve housing 100 are connected to vent line 64, which fluidly communicates fuel tank 54 to the intake side of carburetor 34, and inlet port 152 and outlet port 154 of second valve housing 130 are connected to fuel line 62, which fluidly communicates fuel tank 54 with fuel bowl 48 of carburetor 34. Alternatively, the foregoing arrangement may be reversed, in which inlet port 122 and outlet port 124 of first valve housing 100 are connected with fuel line 62, and inlet port 152 and outlet port 154 of second valve housing 130 are connected with vent line 64.

In operation, when engine 32 is not running, flywheel 26 is stationary, and ring gear 30 of flywheel does not drive gear 88 of control valve assembly 70. In this position, first spring 116, which has a relatively strong spring force, biases spool valve 104, spool shaft 82, central shaft 86, and spool valve 134 in a downward direction, as shown in FIG. 2, against the bias of the relatively weaker second spring 144. In this position, the end 100 of spool shaft 86 contacts contact engagement portions 98 of flyweights 92 to move flyweights 92 to their radially inward position shown in FIG. 2. Also, shoulder 106 of spool valve 104 blocks inlet port 122 and outlet port 124 of first valve housing 100, and shoulder 136 of spool valve 134 blocks inlet port 152 and outlet port 154 of second valve housing 130, such that vent line 64 and fuel line 62 are closed. In this manner, fuel vapors are trapped within fuel tank 54, and the flow of liquid fuel from fuel tank 54 to fuel bowl 48 of carburetor 34 is blocked.

To start engine 12, crankshaft 24 is cranked in a suitable manner, such as by an operator pulling on a recoil starter, for example. Alternatively, crankshaft 24 may be cranked by an electric starter motor. Upon initial cranking of crankshaft 24, flywheel 26 and ring gear 30 rotate relatively slowly until engine 12 starts, and thereafter, the rotational speed of flywheel 26 and ring gear 30 rapidly increases. However, even when flywheel 26 and ring gear 30 rotate relatively slowly upon initial cranking of crankshaft, gear 88 and central shaft 86 of control valve assembly 70 rotate at a much higher speed than flywheel 26 due to the large difference in diameter between flywheel 26 and gear 88. High speed rotation of gear 88 and central shaft 86 imposes centrifugal force upon flyweights 92, causing flyweights 92 to rotate upon pins 94 outwardly to the radially outward position shown in FIG. 3, in which engagement portions 98 of flyweights 92 engage end 100 of spool shaft 82 to translate spool shaft 82 upwardly upon central shaft 86, such that spool shaft 82 engages and translates spool valve 104 against the bias of first spring 116 to a position in which groove 110 of spool valve 104 is aligned with inlet port 122 and outlet port 124 of first valve housing to establish flow of fuel vapors through vapor line 64 from fuel tank 54 to inlet side 44 of carburetor 34. Air within first valve housing 100 may vent therefrom to the atmosphere as necessary through vent hole 120 to accommodate the sliding movement of spool valve 104 within bore 102 of first valve housing 100.

Concurrently, the upward movement of spool shaft 82 allows corresponding upward movement of central shaft 86 under the bias force of second spring 144. Upward movement of central shaft 86 translates gear 88 with respect to ring gear 30 of flywheel 26 as shown in FIG. 3, however, ring gear 30 and gear 88 remain in meshing engagement. Additionally, upward movement of central shaft 86 allows second spring 44 to move spool valve 134 to a position in which groove 140 of spool valve 134 aligns with inlet port 152 and outlet port 154 of second valve housing 130 to establish flow of liquid fuel through fuel line 62 from fuel tank 54 to fuel bowl 48 of carburetor 34. Air within second valve housing 130 may enter therein as necessary through vent hole 148 to displace the expanding volume within second valve housing 130 between shoulder 138 and end wall 150 of second valve housing 130. The foregoing open position of control valve assembly 70, shown in FIG. 3, is maintained during running of engine 12.

Upon shutdown of engine 12, a decrease in the rotational speed of flywheel 28 causes a corresponding decrease in the rotational speed of gear 88 of control valve assembly 70, reducing the centrifugal force imposed upon flyweights 92. Eventually, when flywheel 28 reaches a very low speed near stoppage of engine 32, the bias force of first spring 116 overcomes the centrifugal force imposed upon flyweights 92, and first spring 116 biases spool valve 104 and spool shaft 82 downwardly such that end 100 of spool shaft 82 contacts engagement portions 98 of flyweights 92 to rotate flyweights 92 radially inwardly back to the position shown in FIG. 2. Concurrently, movement of spool shaft 82 causes central shaft 86 and spool valve 134 to also move downwardly against the bias of second spring 144 to the position shown in FIG. 2. In this manner, movement of spool valve 104 of first valve housing 100 and spool valve 134 of second valve housing 130 moves shoulders 108 and 138 thereof into blocking relationship with inlet ports 122 and 152 and outlet ports 124 and 154 of first and second valve housings 100 and 130, respectively, as shown in FIG. 2. Thus, upon engine shutdown, vent line 64 is blocked such that fuel vapors within fuel tank 54 are trapped within fuel tank 54, and fuel line 62 is blocked such that the supply of liquid fuel from fuel tank 54 to fuel bowl 48 of carburetor 34 is prevented.

During movement of spool valve 102 from the position shown in FIG. 3 to the position shown in FIG. 2, air may enter first valve housing 100 through vent hole 120 to displace the expanding volume therewithin. Also, during movement of spool valve 134 from the position shown in FIG. 3 to the position shown in FIG. 2, air within second valve housing 130 may vent through vent hole 148. Optionally, the sizes of vent holes 120 and 148 may be selectively calibrated or dimensioned to control the rate of return of spool valves 104 and 134 from the position shown in FIG. 3 to the position shown in FIG. 2, for example, to allow some degree of continued fuel vapor flow through vent line 64 and fuel flow through fuel line 62 if crankshaft 24 of engine 12 is initially cranked without engine 12 starting, thereby necessitating further cranking of engine 12.

As discussed in the above-incorporated U.S. patent application Ser. No. 10/656,305, the relative sizes of shoulders 106 and 108 and groove 110 of spool valve 104, and the relative sizes of shoulders 136 and 138 and groove 140 of spool valve 134, may be selectively configured such that one of spool valves 104 and 134 opens fuel vapor flow or fuel flow through vent line 64 or fuel line 62 slightly before the other of spool valves 104 and 134 opens fuel vapor flow or fuel flow through vent line 64 or fuel line 62.

Although control valve assembly 70 has been shown and described as driven from flywheel 26 of engine 12, control valve assembly 70 may also be driven from any rotatable member of the drive train of engine 12, such as crankshaft 24 or from a rotatable camshaft, idler shaft, PTO shaft, or governor assembly of engine 12, for example. In one embodiment, control valve assembly 70 may be integrated into an existing governor assembly of engine 12. Because many known governor assemblies include a flyweight mechanism, many of the components of the governor assembly and the control valve assembly 70 may be used in common. In each of the foregoing, control valve assembly 70 is automatically operable responsive to rotation of the rotatable member of the drive train of engine 12, such that when engine 12 is stopped, control valve assembly 70 automatically closes vent line 64 and fuel line 62, thereby trapping fuel vapors within fuel tank 54 and blocking the supply of liquid fuel to carburetor 34. Additionally, the gear or drive ratio between the rotatable member of the drive train of engine 12 and control valve assembly 70 may be sized such that, upon cranking of engine 12 for start-up, the flyweight mechanism of control valve assembly 70 is actuated to automatically open vent line 64 and fuel line 62, venting fuel vapors from fuel tank 54 through vent line 64 to carburetor 34 for consumption by engine 12, and opening the supply of liquid fuel from fuel tank 54 to carburetor 34.

Although control valve assembly 70 has been shown in FIGS. 1–3 disposed vertically, control valve assembly 70 could also be disposed horizontally for use in an engine having a horizontal crankshaft, for example. When disposed horizontally, control valve assembly 70 functions in the same manner as described above. Also, first and second valve housings 100 and 130 need not be disposed on opposite sides of housing 72 of control valve assembly 70. Rather, first and second valve housings 100 and 130 may be located together on one side of housing 72, and may also be integrated into a single valve housing. Although control valve assembly 70 is shown herein as including spool valves, the particular type of valves used in control valve assembly 70 may vary.

Also, although flywheel 26 includes ring gear 30 which engages gear 88 of control valve assembly 70 to actuate control valve assembly 70, the outer circumference or outer periphery of flywheel 26 and gear 88 of control valve assembly 70 could be alternatively be formed as friction wheels in frictional engagement with one another, for example. Also, flywheel 26 need not directly engage gear 88 of control valve assembly 70. For example, one or more idle gears may be disposed between ring gear 30 of flywheel 26 and gear 88, or gear 88 may be driven from flywheel 26 via a belt or a chain drive, for example.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An internal combustion engine, comprising:

a drive train including a rotatable member;

a carburetor;

a fuel tank; and a control valve assembly in fluid communication with said fuel tank and with said carburetor, said control valve assembly including at least one valve member mechanically movable by said rotatable member between a first position when said rotatable member is stationary, in which said valve member prevents fluid communication between said fuel tank and said carburetor, and a second position upon rotation of said rotatable member, in which said valve member allows fluid communication between said fuel tank and said carburetor.

2. The engine of claim 1, wherein said control valve assembly includes a flyweight mechanism in driven relationship with said rotatable member, said at least one valve member movably coupled to said flyweight mechanism.

3. The engine of claim 1, further comprising a fuel line and a vent line each fluidly communicating said fuel tank and said carburetor, said control valve assembly in fluid communication with said fuel line and with said vent line.

4. The engine of claim 3, wherein said control valve assembly further comprises:

a first valve member movable between said first and said second positions to prevent and to allow fluid communication between said fuel tank and said carburetor through said vent line; and a second valve member movable between said first and said second positions to prevent and to allow fluid communication between said fuel tank and said carburetor through said fuel line.

5. The engine of claim 4, wherein said control valve comprises a valve housing mounted to said engine, said valve housing including said first and second valve members.

6. The engine of claim 4, wherein said valve members comprise spool valves mounted upon a common valve shaft, said valve shaft translatable by said flyweight mechanism between said first and said second positions.

7. The engine of claim 1, wherein said drive train includes a crankshaft, and said rotatable member comprises a flywheel mounted to said crankshaft.

8. The engine of claim 7, wherein said flywheel includes a first gear around a circumference thereof, and said control valve assembly includes a second gear in meshing engagement with said flywheel gear.

9. The engine of claim 8, wherein said second gear includes a flyweight mechanism movably coupled to said at least one valve member.

10. An internal combustion engine, comprising:

a drive train including a rotatable member;

a carburetor;

a fuel tank; and a control valve assembly in fluid communication with said fuel tank and with said carburetor, said control valve assembly comprising:

a flyweight mechanism in driven relationship with said rotatable member;

at least one valve member movable by said flyweight mechanism between a first position when said rotatable member is stationary, in which said valve member prevents fluid communication between said fuel tank and said carburetor, and a second position upon rotation of said rotatable member, in which said valve member allows fluid communication between said fuel tank and said carburetor.

11. The engine of claim 10, wherein said drive train includes a crankshaft, and said rotatable member comprises a flywheel mounted to said crankshaft.

12. The engine of claim 11, wherein said flywheel includes a first gear around a circumference thereof, and said control valve assembly includes a second gear in meshing engagement with said flywheel gear, said second gear including said flyweight mechanism.

13. The engine of claim 10, further comprising a fuel line and a vent line each fluidly communicating said fuel tank and said carburetor, said control valve assembly in fluid communication with said fuel line and with said vent line.

14. The engine of claim 13, wherein said control valve further comprises:

a first valve member movable between said first and said second positions to prevent and to allow fluid communication between said fuel tank and said carburetor through said vent line; and a second valve member movable between said first and said second positions to prevent and to allow fluid communication between said fuel tank and said carburetor through said fuel line.

15. The engine of claim 14, wherein said control valve comprises a valve housing mounted to said engine, said valve housing including said first and second valve members.

16. The engine of claim 14, wherein said valve members comprise spool valves mounted upon a common valve shaft, said valve shaft translatable by said flyweight mechanism between said first and said second positions.

17. An internal combustion engine, comprising:

a drive train including a rotatable member;

a carburetor;

a fuel tank;

a fuel line and a vent line fluidly communicating said fuel tank and said carburetor; and control valve means mechanically driven by said rotatable member for preventing flow of fuel and fuel vapors from said fuel tank to said carburetor through said fuel line and said vent line, respectively, when said rotatable member is stationary, and for allowing flow of fuel and fuel vapors from said fuel tank to said carburetor through said fuel line and said vent line, respectively, upon rotation of said rotatable member.

18. The engine of claim 17, wherein said control valve means further comprises first and second valve members associated with said fuel line and said vent line, respectively.

19. The engine of claim 18, wherein said control valve means further comprises flyweight means driven by said rotatable member for moving said first and second valve members.

* * * * *